United States Patent [19]

Seekins

[11] Patent Number: 4,971,048

[45] Date of Patent: Nov. 20, 1990

[54] DUAL VALVE LIQUID TRANSFER TUBE

[75] Inventor: Darrell Seekins, Searsport, Me.

[73] Assignee: The United States of America as represented by the Secretary of the Army, Washington, D.C.

[21] Appl. No.: 413,024

[22] Filed: Sep. 27, 1989

[51] Int. Cl.[5] ..... A62B 7/00

[52] U.S. Cl. ..... 128/202.15; 128/200.24; 239/33

[58] Field of Search ..... 128/202.15, 206.22, 128/200.24, 201.26, 201.28, 911, 203.19, 204.11, 912, 202.27; 604/54; 137/493.8; 222/211, 212, 175, 464, 545; 239/33; 141/301, 302

[56] References Cited

U.S. PATENT DOCUMENTS 4,505,310 3/1985 Schneider ..... 141/114

FOREIGN PATENT DOCUMENTS 526303 10/1921 France ..... 128/202.15

513769 10/1939 United Kingdom ..... 128/202.15

*Primary Examiner*—Clifford D. Crowder

*Assistant Examiner*—Stephen R. Funk

*Attorney, Agent, or Firm*—Richard J. Donahue; Lawrence E. Labadini

[57] ABSTRACT

A liquid transfer device, which may be used as a drinking tube assembly to establish fluid communication between the interior of a canteen and the interior of a protective mask, defines a pair of parallel fluid flow paths which respectively include opposite directly check valves. The parallel flow paths merge at the opposite ends of the assembly to form common flow paths which may be caused to respectively communicate with a suction tube and liquid storage container.

13 Claims, 1 Drawing Sheet

DUAL VALVE LIQUID TRANSFER TUBE

The invention described herein may be manufactured, used and licensed by or for the Government for Governmental purposes without the payment to me of any royalty thereon.

BACKGROUND OF THE INVENTION

1. Field of the Invention

The present invention relates to the transfer of liquid into or out of a closed container and particularly to facilitating the withdrawal of potable liquid from a canteen by an individual wearing a protective mask which isolates the individual's breathing passages from the ambient atmosphere. More specifically, this invention is directed to a tube arrangement defining a pair of parallel flow paths which respectively include oppositely directed check valves and especially to a drinking tube assembly which facilitates the employment of a closed canteen by an individual wearing a protective face mask. Accordingly, the general objects of the present invention are to provide novel and improved methods and apparatus of such character.

2. Description of the Prior Art

While not limited thereto in its utility, the present invention is particularly well suited for use in establishing liquid flow communication between a protective respiratory mask and a canteen.

There may, of course, be occasions where it is necessary to allow an individual wearing a protective mask to drink from a canteen or other closed liquid storage container. In the past, communication between the interior of the mask and canteen has been established by means of a single tube. The single tube drinking system has a number of inherent disadvantages. Firstly, the canteen must be raised at least to the level of the mask in order to obtain liquid flow. Also, with the single tube system, as liquid is withdrawn from the canteen a vacuum is created therein. The vacuum, in turn, limits the amount of liquid which can be withdrawn. Thus, for each swallow, the user must expend the effort of sucking liquid through the tube and, subsequent to drinking, must blow back into the canteen to pressurize the canteen, thus allowing more fluid to exit.

A further disadvantage of the prior single tube system is that the canteen cannot be completely filled with the cap on, as may be necessary to prevent contamination, because a positive pressure will build up inside the canteen thus limiting the amount of liquid which can be delivered thereto.

SUMMARY OF THE INVENTION

The present invention overcomes the above-briefly discussed and other deficiencies and disadvantages of the prior art by providing a technique for withdrawing liquid from, and if desired also delivering liquid to, a closed vessel such as a canteen and a tube assembly for use in the practice of such technique. A drinking tube assembly in accordance with the invention defines a pair of parallel flow paths which are each provided with at least a first check valve, the check valves in the two flow paths operating in opposite directions. The parallel flow paths merge at the opposite ends of the tube assembly to form common flow paths which respectively may be caused to communicate with the interior of a liquid storage container and a suction, i.e., a drinking, tube or the like. If deemed necessary or desirable, one or both of the common flow path defining ends of the tube assembly may be provided with quick disconnect type fittings which cooperate with complementary fittings on the storage container and/or a protective mask.

BRIEF DESCRIPTION OF THE DRAWING

The present invention may be better understood and its numerous objects and advantages will become apparent to those skilled in the art by reference to the accompanying drawing wherein like reference numerals refer to like elements in the figures and in which.

DESCRIPTION OF THE DISCLOSED EMBODIMENT

Figures 1, 2:
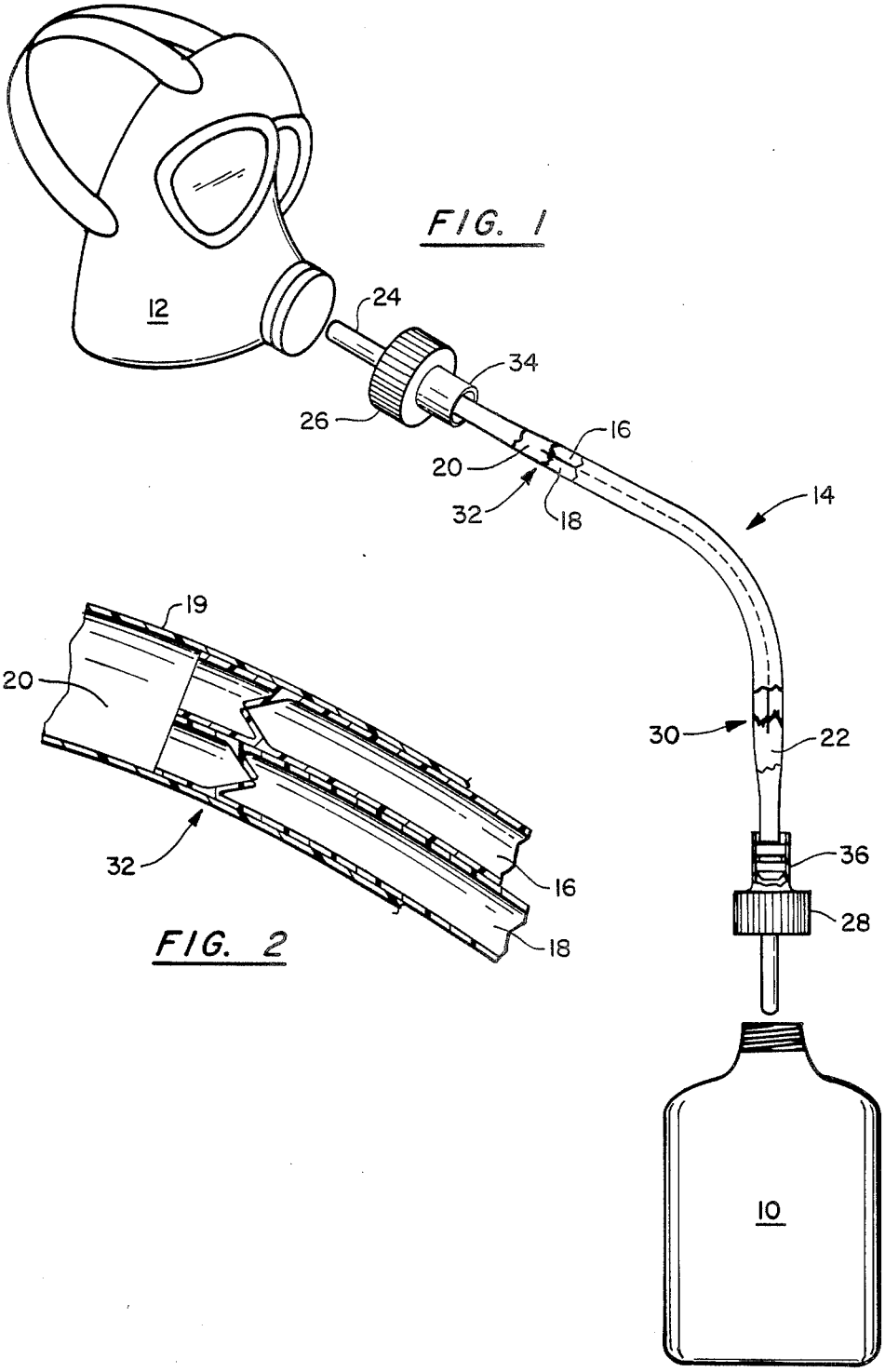
FIG. 1 is a perspective schematic view of a preferred embodiment of the invention employed as a drinking tube assembly.
FIG. 2 is an enlarged cross-sectional view of a portion of the apparatus of FIG. 1.

As indicated above, while not limited thereto in its utility, the present invention is particularly well suited to facilitate the drinking of liquid stored in a container such as a canteen, indicated at 10, by military personnel using a protective mask, for example a mask as described in military specification MIL-M-51282, Mask, Chemical, Biological, Field, which is indicated at 12. A preferred embodiment of the drinking tube assembly is indicated generally at 14 and comprises flexible tube means which define a pair of parallel conduits or flow paths 16 and 18. The structure of the tube assembly 14 is shown schematically in the drawing and the parallel flow paths 16, 18 may, as represented in FIG. 2 for example, be defined by adhesively bonding a pair of plastic tubes together and thereafter inserting the two tubes into a single outer tube 19 which functions as a sheath. In this case, the outer tube will, in some suitable manner, be bonded to the parallel inner tubes such that fluid is precluded from flowing between the inner and outer tubes.

At the opposite ends of the tube assembly 14, i.e., between the ends of the parallel flow paths 16 and 18 and the ends of the tube assembly, the tube assembly defines single, i.e., common, flow paths 20 and 22. The flow paths 20 and 22 are, in the manner to be described below, in fluid flow communication with the parallel flow paths 16 and 18.

The single flow path 20 terminates at a mouthpiece or suction tube 24 which extends from a cap 26. Suction tube 24 will form an extension of tube assembly 14 and will typically extend into the interior of the mask 12 when the assembly is in use. Depending on construction, the suction tube 24 may be integral with the tubular member which defines flow path 20 or may be a separate member. If the tubular member passes through cap 26, the exterior of the tube assembly is sealed to cap 26. The cap 26 mechanically engages the mask 12 in any suitable manner to capture the suction tube 24 in a position where it may be employed for drinking purposes.

The opposite end of the tube assembly 14, i.e., the end which defines the common flow path 22, may extend through and be sealed to a cap 28. Cap 28 has a rotatable portion which mates with the threaded neck of the canteen 10. With the cap 28 connected to the canteen 10, the free open end of the flow path 22 defining portion of the tube assembly 14 will extend into the canteen.

The parallel flow paths 16 and 18 are provided with oppositely acting check valves. The check valves are preferably located adjacent the ends of the parallel flow paths which are in proximity to common flow path 22 and at the same level. As another alternative, a single check valve may be located at the upstream end of each of the flow paths 16 and 18. In the disclosed embodiment, the tube assembly 14 is provided with a pair of lower check valves, indicated generally at 30, and a pair of upper check valves, indicated generally at 32. As shown in FIG. 2, which is an enlarged cross-sectional view of the upper pair of check valves 32, the valves may be defined by cooperating flaps of the resilient material from which the tube assembly is fabricated. Pressure responsive flap-type valves of this type are well known in the art and are widely used in various types of pneumatic apparatus.

If deemed necessary or desirable, quick disconnect couplings may be integrated with the tube assembly 14 at one or both ends thereof in the regions of the common flow paths. An example of such a quick disconnect coupling has been indicated schematically at 34. Coupling 34 will cooperate with a valve member inside the cap 26. In this arrangement, the cap 26 may remain permanently affixed to the mask 12 and the tube assembly simply plugged into the cap when the wearer wishes to drink. A similar quick disconnect coupling 36 may be employed at the opposite end of tube assembly 14 so as to cooperate with a valve assembly in the cap 28 which then could remain on the canteen 10.

In use, the opposite ends of the tube assembly 14 are respectively coupled, either using caps 26, 28 which form a part thereof or employing quick disconnect fittings, to the mask 12 and canteen 10. The canteen is then held at an angle which permits the liquid inside to exit the cap. However, the canteen does not have to be held at the height of the mask, i.e., the end of the tube assembly 14 or the extension thereof defined by a tube which is integral with a cap 28 need only be submerged. The user then blows air into the canteen. This is accomplished by exhaling into the mouthpiece 24 inside of the mask. The exhaled air travels through the mouthpiece and down the tube assembly, passing through the one-way valve(s) in the flow path 18. After exhaling into the canteen, the user sucks on the mouthpiece 24 to draw water up from the canteen via the flow path 16 and the one-way valve(s) associated therewith. After each drink from the canteen, the user again exhales into the mouthpiece to pressurize the canteen for the next drink. The one-way valve(s) in the flow path 16 prevent most of the liquid which has been drawn up into the tube assembly 14 from returning to the canteen 10 even when air is being blow into the canteen, i.e., only the small amount of liquid in the common flow paths 20 and 22 and the couplings will return to the canteen with the air. Accordingly, when compared to the prior art, the amount of effort required to get a drink is decreased because fluid does not have to be sucked all the way from the canteen to the mask more than once during each drinking cycle.

The employment of a quick disconnect coupling at the canteen end of the tube assembly 14 permits the canteen 10 to be completely filled while the cap 28 is on tight and thereby ensures against contamination of water transferred to the canteen from a larger sealed reservoir. Thus, liquid delivered to the mask end of the tube assembly 14, via the quick disconnect coupling 34 for example, can flow through the one-way valve(s) in flow path 18 and into the canteen while air displaced by the inflowing liquid, rather than being trapped and pressurized, can escape via the flow path 16 and the one-way valve(s) incorporated therein.

It is also to be noted that, when the present invention is used in a cold environment, the user can suck the tube assembly 14 dry after the canteen has been returned to a position similar to that shown in the drawing, presuming that the end of the tube assembly is at that time above the level of the liquid in the canteen. This will prevent the tube assembly, and the caps and quick disconnect fittings if a part thereof, from freezing.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for use in the withdrawal of liquid from a closed storage container comprising:

first flexible tube means for defining a first liquid flow path, said first tube means having oppositely disposed first and second ends;

one-way valve means positioned in said first tube means for permitting fluid to flow in a first direction in said first flow path and for impeding fluid flow in said first flow path in a second direction opposite to said first direction;

second flexible tube means for defining a second liquid flow path, said second tube means having oppositely disposed first and second ends;

one-way valve means positioned in said second tube means for impeding the flow of fluid in said second flow path in the first direction and for permitting fluid to flow in said second flow path in the second direction;

third tube means coupled to the first ends of said first and second tube means for defining a first common flow path in fluid communication with said first and second flow paths, said third tube means having a free open end;

fourth tube means coupled to the second ends of said first and second tube means for defining a second common flow path in fluid communication with said first and second flow paths, said fourth tube means having a free open end; and first connecting means for mechanically connecting said third tube means to a storage container whereby the free open end of said third tube means may be placed in fluid communication with the interior of the storage container.

2. The apparatus of claim 1 wherein said valve means each comprise a pressure responsive member positioned within said tube means.

3. The apparatus of claim 1 wherein said first connecting means comprises a cap and wherein said third tube means extends through said cap.

4. The apparatus of claim 1 further comprising:

second connecting means adapted to mechanically connect said fourth tube means to a protective mask, said second connecting means adapted to permit fluid communication to be established between the common flow path defined by said fourth tube means and the interior of a mask.

5. The apparatus of claim 4 wherein said second connecting means comprises a cap and wherein said fourth tube means extends through said cap and defines a suction tube.

6. The apparatus of claim 5 wherein said first connecting means comprises a cap and wherein said third tube means extends through said cap.

7. The apparatus of claim 6 wherein said valve means each comprise a pressure responsive member positioned within said tube means.

8. The apparatus of claim 1 wherein said first connecting means comprises a cap for the container, a disconnect coupling in part carried by said third tube means and in part comprising said cap, and a tubular extension of said third tube means, said tubular extension being affixed to said cap.

9. The apparatus of claim 8 wherein said valve means each comprise a pressure responsive member positioned within said tube means.

10. The apparatus of claim 1 wherein said first and second flow paths are substantially parallel at all points therealong.

11. The apparatus of claim 10 wherein said tube means are maintained in abutting relationship.

12. The apparatus of claim 11 wherein said valve means each comprise a pressure responsive member positioned within said tube means.

13. The apparatus of claim 12 further comprising:

second connecting means adapted to mechanically connect said fourth tube means to a protective mask, said second connecting means adapted to permit fluid communication to be established between the common flow path defined by said fourth tube means and the interior of a mask.

* * * * *